United States Patent [19]

Steiner et al.

[11] Patent Number: 4,507,832

[45] Date of Patent: Apr. 2, 1985

[54] METHOD AND APPARATUS FOR THE CONTINUOUS TREATMENT OF YARN

[75] Inventors: Erwin Steiner, Clover, S.C.; Peter H. Stahlecker, Charlotte, N.C.

[73] Assignee: Technology Consulting Corporation, Charlotte, N.C.

[21] Appl. No.: 421,865

[22] Filed: Sep. 23, 1982

[51] Int. Cl.[3] ..... D02G 1/20

[52] U.S. Cl. ..... 28/248; 28/281; 198/503

[58] Field of Search ..... 28/248, 281, 289; 68/5 D; 198/503

[56] References Cited

U.S. PATENT DOCUMENTS

| | | | |
|---|---|---|---|
| 3,209,559 | 10/1965 | Sharp et al. . | |
| 3,303,698 | 2/1967 | Loepfe . | |
| 3,408,500 | 10/1968 | Carr . | |
| 3,485,339 | 12/1969 | Miller et al. | 198/503 |
| 3,490,710 | 1/1970 | Muhlhausler . | |
| 3,683,650 | 8/1972 | Hirschburger | 28/281 |
| 3,717,751 | 2/1973 | Fluck | 198/503 |
| 3,780,541 | 12/1973 | Haynes . | |
| 3,844,504 | 10/1974 | Lawson . | |
| 3,858,415 | 1/1975 | Wilson et al. . | |
| 3,889,493 | 6/1975 | Farmer et al. . | |
| 3,944,049 | 3/1976 | Graybill | 198/503 |
| 4,026,484 | 5/1977 | Naegeli . | |
| 4,092,006 | 5/1978 | Jacobsson . | |
| 4,169,707 | 10/1979 | Gloeckler | 28/281 X |
| 4,174,799 | 11/1979 | d'Agnolo . | |
| 4,277,867 | 7/1981 | Lucke . | |
| 4,297,095 | 10/1981 | Silcox et al. | 28/281 X |
| 4,305,184 | 12/1981 | Woythal . | |
| 4,316,370 | 2/1982 | Steiner . | |
| 4,320,563 | 3/1982 | d'Agnolo . | |

FOREIGN PATENT DOCUMENTS

| | | | |
|---|---|---|---|
| 114886 | 4/1967 | Denmark | 198/503 |

*Primary Examiner*—Werner H. Schroeder
*Assistant Examiner*—Andrew M. Falik
*Attorney, Agent, or Firm*—Bell, Seltzer, Park & Gibson

[57] ABSTRACT

A method and apparatus for the continuous heat treatment of a carpet yarn or the like is disclosed, and wherein the yarn is advanced in loop form through a heat treatment chamber and then along a downstream accumulation zone. A control system is provided for insuring that all portions of the yarn remain in the heat treatment chamber for a predetermined residence time, and such that all portions of the yarn will possess uniform properties and appearance in a finished carpet. The control system continuously monitors the number of loops of yarn in the apparatus, and in the event that the number of loops either exceeds a predetermined maximum or is less than a predetermined minimum, a yarn severing mechanism located upstream of the heating chamber is actuated. By appropriate selection of the maximum and minimum numbers, all of the yarn downstream of the severing mechanism will be able to pass through the heating chamber in the predetermined residence time, and thus no off-standard yarn will be produced.

13 Claims, 5 Drawing Figures

METHOD AND APPARATUS FOR THE CONTINUOUS TREATMENT OF YARN

Figures 1, 2, 3, 4, 5:
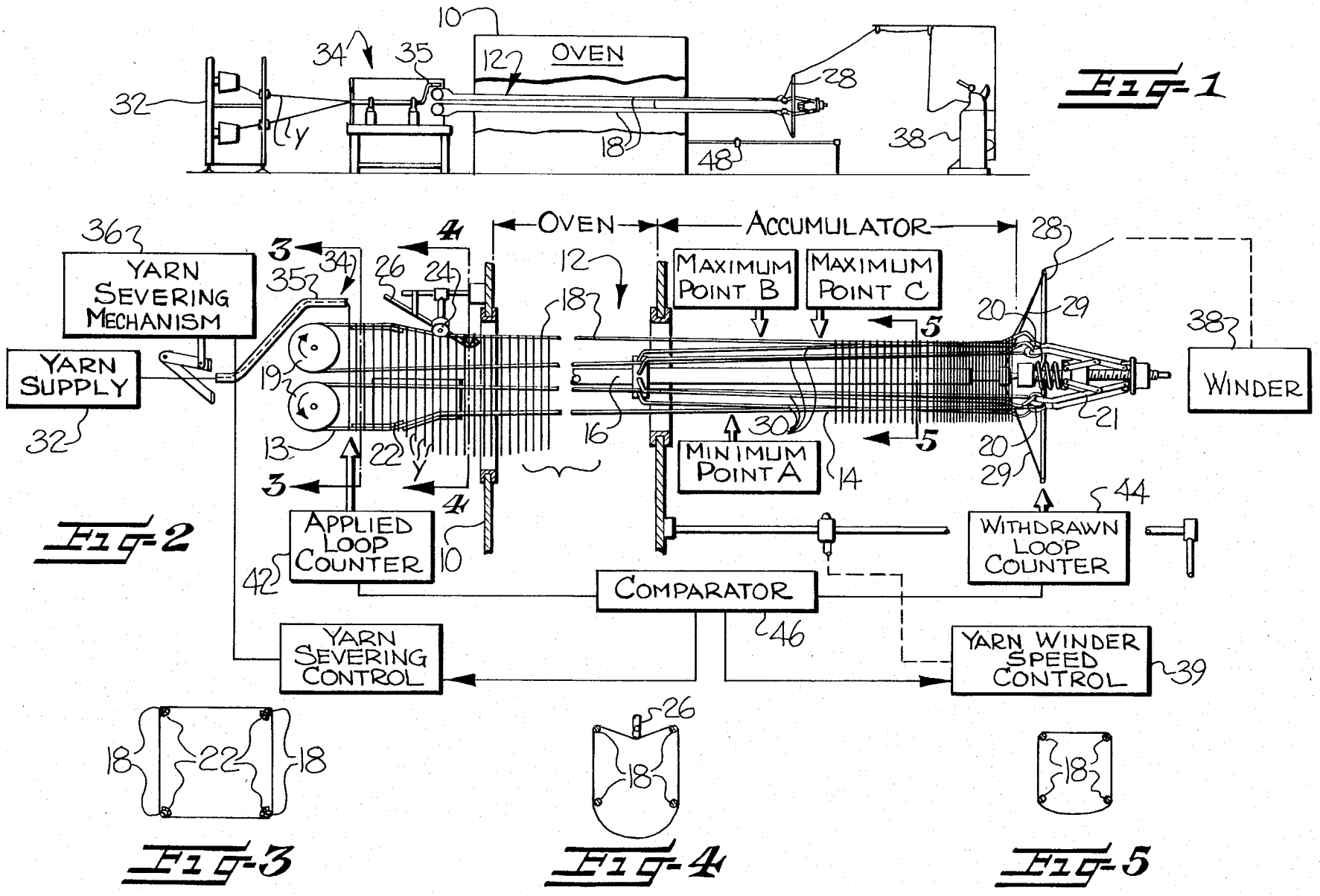

The present invention relates to a method and apparatus for the continuous treatment of yarn, and which is characterized by the ability to insure that all portions of the yarn are treated under substantially uniform conditions to thereby insure uniformity of the finished product.

Applicant's prior U.S. Pat. No. 4,316,370 discloses a continuous yarn heat setting machine which comprises a number of separate conveyors for continuously conveying a number of yarns through a heat treatment chamber. Each conveyor comprises four belts arranged in a rectangular pattern when viewed in cross section, and a yarn winding flyer is provided at the entry end of each conveyor for winding a running yarn in helical loops around the periphery of the four belts. The belts of each conveyor are advanced in unison through the heating chamber, and so that the yarn is conveyed in a relaxed, looped configuration which permits the yarn to freely shrink. Each conveyor entends beyond the downstream end of the chamber to define an accumulation zone, and the yarn is withdrawn from the accumulation zone by an associated take-up winder.

In processing many types of yarn, such as nylon carpet yarn, it is important that all portions of all yarns be maintained in the heat treatment chamber for a uniform predetermined residence time, since the residence time effects the properties of the yarn. As is well understood, different yarn properties can result in visible and unsightly streaks in the finished carpet. This requirement for a uniform residence time creates a potential problem when the winder stops for doffing, or for piece-up of a broken yarn, since the yarn will not then be removed from the accumulation zone by the winder, and it will tend to condense and reversely accumulate in the accumulation zone and "back up" into the heating chamber. To prevent such yarn "back up", it is conventional to equip the machine described in the above patent with a photoelectric sensor which senses any excessive reverse accumulation. When such excessive accumulation is sensed, a signal is given which acts to increase the operating speed of the winder when it starts back into operation, and the winder is continued at its higher or jump speed until the accumulation is reduced to an acceptable amount as determined by the sensor.

While the above accumulation control system is satisfactory under most operating conditions, unusual circumstances occasionally occur which will result in the yarn being maintained in the heating chamber for either an unduly long period of time, or an unduly short period of time. In either case, the resulting off-standard yarn must then be cut and discarded in order to insure that it is not subsequently processed into a carpet. One such circumstance arises where the winder stops for an unduly long time during doffing, or during yarn piece-up. When this occurs, the accumulating yarn "backs up" into the heating chamber, causing its residence time to be increased. The same result could occur in the event of a failure of the photoelectric sensor. In addition, a sensor failure could result in the higher winder speed continuing for an excessively long period of time, which would result in the yarn being totally removed from the accumulation zone and then pulled directly from the heating chamber, thereby resulting in some of the yarn having too little time in the chamber.

It is accordingly an object of the present invention to provide a method and apparatus for the continuous treatment of yarn, which effectively controls the processing so as to avoid the production of off-standard yarn.

It is a more particular object of the present invention to provide a method and apparatus for the continuous heat treatment of yarn, and which is able to insure that all portions of the yarn are processed under substantially uniform conditions, to thereby insure uniformity of the finished product, and to thereby avoid the need to cut and discard off-standard yarn.

These and other objects and advantages of the present invention are achieved in the embodiment illustrated herein by the provision of a method and apparatus which includes the continuous steps of forming a running yarn into helical loops, conveying the loops through the heating chamber and along an accumulation zone, and withdrawing the loops of yarn from the accumulation zone. The total number of loops in the treatment chamber and accumulation zone is continuously monitored, preferably by counting the loops applied at the upstream end of the machine and counting the loops withdrawn from the accumulation zone. Upon the monitored number of loops exceeding a predetermined maximum, an output signal is generated, and an output signal is also generated upon the number of loops being less than a predetermined minimum. Preferably, the output signal serves to actuate a yarn severing mechanism positioned at the upstream end of the chamber. By appropriate selection of the predetermined maximum and the predetermined minimum number of loops, all portions of the severed yarn will pass through the treatment chamber in the predetermined residence time, and thus no off-standard yarn will be produced.

As one important aspect of the present invention, it has been found that counting the loops of yarn at the entry end and the exit end of the apparatus provides an effective measurement of the accumulation of the yarn in the apparatus. In this regard, it will be understood that it is not feasible to determine the accumulation by measuring the length of the yarn fed into and withdrawn from the apparatus, since the yarn typically will shrink by an amount up to 25 percent in the heating chamber. Thus a highly accurate determination of the accumulation would be difficult to achieve. With the present invention, such shrinkage will not be a factor, since the number of yarn loops passing through the machine will not change with the shrinkage of yarn.

Some of the objects having been stated, other objects and advantages will appear as the description proceeds when taken in connection with the accompanying drawings, in which FIG. 1 is a partly schematic side elevation view of a continuous yarn heat setting apparatus embodying the features of the present invention;

FIG. 2 is a fragmentary side elevation view of the yarn conveyor portion of the apparatus, and illustrating schematically some of the control functions of the apparatus; and FIGS. 3, 4 and 5 are end elevation views of the yarn conveyor portion of the apparatus, taken substantially along the lines 3—3; 4—4; and 5—5 in FIG. 2, respectively.

Referring more particularly to the specific embodiment of the invention as disclosed in the drawings, there is illustrated a yarn heat setting apparatus which comprises a heat treatment chamber 10 through which the yarn Y to be treated is conveyed. The chamber 10 is adapted to be heated by super-heated steam or the like, to a temperature in a range of between about 190–220 degrees C.

A yarn conveyor 12 extends horizontally through the chamber, and includes a yarn receiving zone 13 immediately upstream of the chamber, and which is generally coincident with the section line 3—3 in FIG. 2. The conveyor 12 also extends for a distance of several feet beyond the heating chamber in the downstream direction, to define an accumulation zone 14. The conveyor 12 is composed of a central mast 16 which is suitably supported adjacent the upstream end of the conveyor, and which extends in cantilever fashion along the length of the chamber and accumulation zone. Four endless belts 18 are supported on the mast and are arranged in a rectangular pattern in cross section, with each belt being rotatably mounted about a pair of rollers 19 and 20 which are carried by the mast. The four downstream rollers 20 are mounted for radial adjustment by means of the telescoping mechanism 21, whereby the size of the rectangular arrangement may be varied. The belts 18 are driven in unison by a suitable drive mechanism (not shown) to advance a yarn therealong, and in the manner further described below.

The conveyor 12 further includes runners 22 which are disposed to underlie the outer run of each belt at the yarn receiving zone, and immediately adjacent the upstream rollers 19. The runners 22 thereby maintain the separation of the belts at a fixed predetermined distance, which typically is set so that the circumferential distance about the belts is about one meter. Downstream of each runner, there is positioned a roller 24 which is disposed to contact the upper run of the associated belt so that the belts contract toward each other and thereby reduce the effective circumferential distance about the four belts. An inclined rod 26 is also mounted so as to contact the upper portion of the yarn loops as further described below. At the downstream end of the accumulation zone, there is mounted a ring 28, which is concentric to the mast 16 and is supported on the mast by means of a plurality of radial arms 29. A plurality of slats 30 are also supported on the mast so as to incline outwardly beyond the periphery of the belts as they approach the ring 28. The slats 30 thereby serve to engage the advancing yarn loops at a point immediately adjacent the radial arms 29, and act to physically block the further advance of the yarn loops.

A yarn creel 32 is mounted upstream of the chamber 10, which delivers one or more running yarns Y to a winding machine 34. The winding machine is conventional and includes a flyer 35 which rotates about the axis of the conveyor mast 16 so as to deposit the running yarn about the four belts at the yarn receiving zone 13 of the conveyor. The rotational speed of the flyer is preferably interconnected to the drive of the conveyor 12 by a suitable variable gear box (not shown), whereby the axial space between the loops on the conveyor may be varied. A yarn severing mechanism 36 is also mounted on the winder immediately upstream of the flyer. A yarn take-up winder 38 is disposed downstream of the chamber 10 for withdrawing the yarn from the accumulation zone of the conveyor, and winding the yarn into finished packages. The take-up winder 38 is conventional, and includes a speed control 39 whereby it may be selectively operated at a normal speed and a higher or jump speed. While the illustrated apparatus illustrates a single conveyor 12 extending through the chamber 10, it will be understood that a number of such conveyors may extend through the chamber, and with each conveyor having a separate associated yarn winding flyer and take-up winder.

To describe the operation of the above-described components of the apparatus, one or more yarn ends Y from the creel 32 are guided through the rotating flyer 35, which acts to wind the yarn around the four traveling endless belts 18 to form helical, axially spaced apart and downwardly hanging loops. As the loops are advanced to the area adjacent the section line 4—4, they become relaxed into a skein-like form as seen in FIG. 4, by reason of the fact that the belts are moved toward each other by the rollers 24, and by contact with the rod 26. The loops of yarn enter the heat setting chamber 10, where they are free to shrink to the configuration represented in FIG. 5. The loops then move along the accumulation zone 14, and they are removed from the accumulation zone by the takeup winder. In the event the loops should reach and contact the slats 30 at the downstream end of the accumulation zone, the advance of the loops will cease and they will tend to condense and reversely accumulate or "back-up" in a direction toward the chamber 10.

In accordance with the present invention, means are provided for monitoring the number of loops in the treatment chamber 10 and accumulation zone 14, and for providing a control signal upon the monitored number of loops either exceeding a predetermined maximum or being less than a predetermined minimum. By this arrangement the control signal will indicate a condition wherein the loops may remain in the treatment chamber for either an unduly long or an unduly short residence time. More particularly, the number of yarn loops are monitored by an arrangement which includes a counter 42 disposed adjacent the flyer for counting the revolutions thereof, and a second counter 44 mounted on the ring 28 for counting each loop as it moves around the ring 28 during its withdrawal from the accumulation zone 14 and its movement toward the take-up winder 38. The outputs of these two counters are fed to an electronic comparator 46 of a suitable computer control, whereby the number of loops in the machine is continuously monitored.

In controlling the operation of the illustrated embodiment of the apparatus, three critical yarn accumulation amounts are initially determined. First, there is selected a predetermined minimum number of loops, wherein all of the yarn downstream of the severing mechanism 36 will pass through the treatment chamber 10 in loop form and in the predetermined residence time, prior to being withdrawn from the conveyor by the winder 38. Thus, for example, if the winder 38 should remain in jump speed for an unduly long period of time, a control signal will be generated in sufficient time such that all of the yarn then present in the treatment chamber 10, and more particularly all yarn downstream of the severing mechanism 36, will pass through the chamber in the proper residence time. This minimum number of loops will typically extend to the point A in FIG. 2 during operation of the apparatus.

There is also selected a predetermined maximum number of yarns, represented by the point B in FIG. 2, which is selected so that the number will be reached during reverse accumulation, and wherein the accumulation zone has sufficient remaining length to accommodate all of the yarn then present in the treatment chamber and downstream of the severing mechanism. Thus, for example, in the event of the failure of the take-up winder to operate, all of the yarn downstream of the severing mechanism when the reversely accumulating loops reach the point B, will be able to pass completely through the chamber in the predetermined residence time.

Upon either of the minimum point A or maximum point B being reached, a signal is sent from the computer control to the severing mechanism 36 to cut the yarn. As will be apparent, and by reason of the particular placement of the points A and B, all portions of the yarn will pass through the treatment chamber in the predetermined residence time, and no off-standard yarn will be produced.

The third critical yarn accumulation amount is indicated by the point C in FIG. 2. This amount is somewhat less than the predetermined maximum point B, and is thus reached during the reverse accumulation of the yarn somewhat prior to the point B being reached. Upon reaching the point C, a control signal is sent to the take-up winder to operate in its jump speed. This jump speed will continue until the accumulation has been reduced to a level below that represented by point C, and then the winder will return to its normal speed. Thus it will be understood that the point B will be reached only in the event of the failure of the winder to reduce the reverse accumulation.

To program the appararus for operation, it is also necessary to initially determine the desired residence time of the yarn within the treatment chamber. This residence time may vary depending on the temperature and moisture content in the chamber, and the composition and construction of the yarn. Typically, the residence time will range between about 50 to 60 seconds for conventional carpet yarn and with the treatment chamber operating at about 220 degrees C.

After the residence time is determined, the rotational speed of the flyer is adjusted to the yarn delivery speed, so as to deposit the yarn about the belts 18 at the yarn receiving zone 13 withour substantial slack. For example, if the circumference about the belts in the receiving zone is about one meter, and if the yarn speed is 500 meters per minute, then the flyer should revolve at a speed of 500 revolutions per minute. A geared interconnection between the flyer and conveyor drive is then selected, and such that the conveyor is advanced at a speed to provide a desired axial separation between the loops, and which also provides a residence time in the chamber which is within the established parameters.

Once the above variables are set, it is then necessary to determine the number of loops which will be present in the treatment chamber and along the accumulation zone at each of the three critical points A, B, and C as described above. In this regard, it will be understood that the number of loops at the minimum point A will remain fixed under a given set of operating speeds, regardless of the count of the yarn being processed. However, the number of loops at points B and C will vary depending upon the yarn count, since the thickness of the yarn will influence the extent of the reverse yarn accumulation. Once these numbers are determined, they are stored in the memory of the computer control.

After the apparatus has been set into operation, the computer control continuously monitors the total number of loops in the processing chamber and accumulation zone by comparing the outputs of the input loop counter 42 and the output loop counter 44. By design of the computer control program, once the number of loops exceeds a selected minimum, such as the number associated with minimum point A, any subsequent return to such minimum number, which might for example be caused by the winder improperly remaining in its jump speed, will result in the severing mechanism 36 being actuated to sever the yarn at the upstream end of the treatment chamber. As noted above, the placement of the minimum point A is such that all portions of the yarn will be able to pass through the treatment chamber in the proper residence time without being prematurally withdrawn by the winder.

In the event the loops reach the stop defined by the slats 30, and reversely accumulate back to point C, the comparator will note such fact from the number of loops then present on the apparatus, and it will signal the winder to operate at its jump speed. The high speed operation of the winder continues until the number of loops is reduced to an acceptable level. Should the winder fail to reduce the reverse accumulation for some reason, and the loops continue to back-up to the point B, the computer control will then actuate the severing mechanism 36. Here again, the placement of the point B is such that all portions of the yarn will be able to pass through the treatment chamber in the predetermined residence time.

In the illustrated embodiment, a photoelectric eye 48 provides a redundant signal for actuating the winder 38 to operate at its jump speed upon the reverse accumulation reaching the point C. As will be understood, other similar redundant sensing systems could be provided for monitoring the minimum point A and the maximum point B, and thereby improve the reliability of the control function.

In the case of finer yarn counts, it is possible to run two or more yarn ends parallel to each other on each conveyor, and to separate these ends to individual packages at the winder, note the applicant's prior U.S. Pat. No. 4,316,370 for a further more detailed disclosure of such an arrangement.

In the drawings and specification, there has been set forth a preferred embodiment of the invention, and although specific terms are employed, they are used in a generic and descriptive sense only and not for purposes of limitation.

That which is claimed is:

1. A method of continuously treating a running yarn, and characterized by the ability to insure a substantially uniform treatment of all portions of the yarn and thereby avoid the production of off-standard yarn, and comprising the continuous steps of forming a running yarn into helical loops, conveying the thus formed loops at a predetermined speed through a treatment chamber and along an accumulation zone positioned downstream of the chamber, withdrawing the loops from the accumulation zone, monitoring the number of loops in the treatment chamber and accumulation zone, providing a control signal upon the monitored number of loops exceeding a predetermined maximum, and also upon the monitored number of loops being less than a predetermined minimum, whereby the control signal will indicate a condition wherein the loops may remain in the treatment chamber for either an unduly long or an unduly short residence time, physically blocking the further advance of the loops at the downstream end of the accumulation zone, whereby the loops tend to gather and accumulate in a reverse direction along the accumulation zone in the event the withdrawing step is at an inadequate speed, and selecting said predetermined maximum and said predetermined minimum number of loops so that the loops then present in the treatment chamber will pass through the treatment chamber in a predetermined residence time.

2. The method as defined in claim 1 comprising the further step of selecting said predetermined maximum number of loops so that the number will be reached upon the reverse accumulation reaching a predetermined point along the length of the accumulation zone, and with the accumulation zone having sufficient remaining length to at least accommodate the loops of yarn then present in the treatment chamber.

3. The method as defined in claim 2 comprising the further step of selecting said predetermined minimum number of loops so that the loops then present in the treatment chamber will not be withdrawn prior to all such loops passing through the treatment chamber in loop form.

4. The method as defined in claim 3 comprising the further step of severing the yarn at a point upstream of the chamber upon receipt of a control signal, and such that all portions of a severed yarn will pass through the treatment chamber in a predetermined residence time.

5. A method of continuously heat setting a running yarn, and characterized by the ability to insure a substantially uniform treatment of all portions of the yarn and thereby avoid the production of off-standard yarn, and comprising the continuous steps of forming a running yarn into helical, axially spaced apart and downwardly hanging loops, conveying the thus formed loops at a predetermined speed through a heated treatment chamber and along an accumulation zone positioned downstream of the chamber, withdrawing the loops of yarn from the accumulation zone, monitoring the number of loops in the processing chamber and accumulation zone, and severing the yarn at a point immediately upstream of the chamber upon the monitored number of loops exceeding a predetermined maximum, and also upon the monitored number of loops being less than a predetermined minimum, with the predetermined maximum and predetermined minimum each being selected such that all of the yarn upstream of and within the treatment chamber at the time the yarn is severed will pass through the chamber at said predetermined speed and thereby receive a treatment which is uniform with that of the remaining portions.

6. The method as defined in claim 5 comprising the further step of increasing the speed of the yarn withdrawing step upon the monitored number of loops exceeding a predetermined number, with said predetermined number being somewhat less than said predetermined maximum.

7. The method as defined in claim 5 or 6 wherein the step of monitoring the number of loops includes counting the loops formed at the upstream end of the treatment chamber, counting the loops withdrawn from the accumulation zone, and comparing the number of formed loops with the number of withdrawn loops to permit the total number of loops to be determined.

8. The method as defined in claim 5 or 6 wherein the step of forming a running yarn into loops includes supporting the loops in a free hanging, relaxed condition in the treatment chamber so as to permit shrinkage thereof.

9. An apparatus for continuously treating a running yarn, and characterized by the ability to insure a substantially uniform treatment of all portions of the yarn and thereby avoid the production of off-standard yarn, and comprising:

a yarn treatment chamber, conveyor means extending through said treatment chamber and extending beyond said chamber to define an accumulation zone, means for winding a running yarn onto the conveyor means at a point immediately upstream of said chamber and so as to form helical loops of the yarn on the conveyor means, and whereby the conveyor means is adapted to carry the loops through said treatment chamber and along said accumulation zone, means for withdrawing the loops of yarn from the accumulation zone, means for monitoring the number of loops in the treatment chamber and accumulation zone, said monitoring means including means for counting the loops formed at the upstream end of the treatment chamber, means for counting the loops withdrawn from the accumulation zone, and means for comparing the number of applied loops with the number of withdrawn loops to permit the total number of loops to be continuously determined, and means for providing a control signal upon the monitored number of loops exceeding a predetermined maximum, or upon the number of loops being less than a predetermined minimum, whereby the control signal will indicate a condition wherein the loops may remain in the treatment chamber for either an unduly long or an unduly short residence time, and wherein said predetermined maximum and predetermined minimum number of loops are each selected such that all of the loops of yarn then present in the treatment chamber will pass through the treatment chamber in a predetermined residence time.

10. The apparatus as defined in claim 9 further comprising means for severing the running yarn at a point immediately upstream of the treatment chamber, and means for actuating said severing means upon receipt of said control signal.

11. The apparatus as defined in claim 10 wherein said predetermined maximum and predetermined minimum number of loops are each selected such that upon actuation of said severing means all of the loops of yarn downstream of said severing means will pass through said chamber in a predetermined residence time which is uniform with the residence time of the remaining portion of the treated yarn.

12. The apparatus as defined in claim 11 further comprising means for providing a further control signal upon the monitored number of loops exceeding a predetermined number which is somewhat less than said predetermined maximum number, and means responsive to such further control signal for increasing the speed of said withdrawing means until the number of loops is reduced.

13. The apparatus as defined in claim 9 wherein said yarn treatment chamber includes means for heat treating the yarn passing therethrough, and said conveyor means includes means for supporting the loops in a free hanging, relaxed condition so as to permit shrinkage thereof.

* * * * *